US006733071B2

(12) United States Patent
Guillot et al.

(10) Patent No.: US 6,733,071 B2
(45) Date of Patent: May 11, 2004

(54) SELF-LOCKING ROCKER RECLINER CHAIR

(75) Inventors: Edmond P. Guillot, Conover, NC (US); Larry W. Edwards, Connelly Springs, NC (US)

(73) Assignee: Hickory Springs Manufacturing Company, Hickory, NC (US)

( * ) Notice: Subject to any disclaimer, the term of this patent is extended or adjusted under 35 U.S.C. 154(b) by 0 days.

(21) Appl. No.: 10/180,657

(22) Filed: Jun. 26, 2002

(65) Prior Publication Data

US 2004/0000803 A1 Jan. 1, 2004

(51) Int. Cl.[7] ..... A47C 1/02; A47C 3/02; A47C 3/03

(52) U.S. Cl. ..... 297/85; 297/259.2; 297/270.1

(58) Field of Search ..... 297/85, 259.2, 297/270.1, DIG. 7

(56) References Cited

U.S. PATENT DOCUMENTS

| | | | | |
|---|---|---|---|---|
| 2,500,789 A | | 3/1950 | Belisle | |
| 2,549,286 A | | 4/1951 | Belisle | |
| 2,606,594 A | * | 8/1952 | Caldemeyer | 297/269.1 |
| 2,907,373 A | | 10/1959 | Katz | |
| 3,163,464 A | | 12/1964 | Martin et al. | |
| 3,243,226 A | | 3/1966 | Katz | |
| 3,279,847 A | | 10/1966 | Re | |
| 3,371,958 A | | 3/1968 | Caldemeyer et al. | |
| 3,379,473 A | | 4/1968 | Mizelle | |
| 3,464,736 A | | 9/1969 | Mizelle | |
| 3,493,264 A | | 2/1970 | Re | |
| 3,622,198 A | | 11/1971 | Re | |
| 3,637,255 A | | 1/1972 | Re | |
| 3,730,585 A | | 5/1973 | Rogers, Jr. et al. | |
| 3,747,973 A | * | 7/1973 | Re | 297/84 |
| 3,767,257 A | * | 10/1973 | Rogers et al. | 297/85 |
| 3,815,954 A | | 6/1974 | Rogers, Jr. et al. | |
| 3,826,532 A | | 7/1974 | Caldemeyer | |
| 3,869,170 A | | 3/1975 | James et al. | |
| 3,904,240 A | | 9/1975 | Rogers, Jr. et al. | |
| 4,179,157 A | | 12/1979 | Shoemaker et al. | |
| 4,194,783 A | | 3/1980 | Cycowicz et al. | |
| 4,212,494 A | * | 7/1980 | Dabney | 297/69 |
| 4,515,407 A | | 5/1985 | Crum | |
| 4,519,647 A | | 5/1985 | Rogers, Jr. | |
| 4,601,513 A | | 7/1986 | Pine | |

(List continued on next page.)

*Primary Examiner*—Peter M. Cuomo
*Assistant Examiner*—Sarah C. Burnham
(74) *Attorney, Agent, or Firm*—Alston & Bird LLP

(57) ABSTRACT

A self-locking rocker recliner is provided. The rocker recliner includes a base frame and a rocking frame that is rockably connected to said base frame. The rocking frame supports seating surfaces of the rocker recliner, such as a seat back, a seat bottom, a footrest, and armrests. The rocking frame includes an upper rocking frame and a lower rocking frame that are movably connected so that the rocker recliner can be adjusted between an upright position and at least one reclined position, such as a TV or fully reclined position. The rocker recliner can be reclined by rotating a recline lever on the side of the rocker recliner, and reclining the rocker recliner can also cause the extension of a footrest. A lockout lever, which is attached to the rocker recliner, is configured to be moved by a user between a locked position and an unlocked position. The lockout lever is linked to a dual-action locking mechanism rotatably attached to the rocker recliner such that rotation of the lockout lever causes a corresponding rotation of the dual-action locking mechanism between a locked position and an unlocked position. Rotation of the dual-action locking mechanism to the locked position prevents rocking of the rocker recliner. The dual-action locking mechanism is also configured to rotate to the locked position when the rocking frame is reclined to the reclined position.

21 Claims, 9 Drawing Sheets

U.S. PATENT DOCUMENTS 4,707,025 A 11/1987 Rogers, Jr.
4,707,026 A 11/1987 Johansson
4,805,960 A 2/1989 Tacker
4,893,871 A 1/1990 Kowalski
RE33,704 E 10/1991 Rogers, Jr.
5,121,966 A 6/1992 Tischler
5,121,967 A 6/1992 Rogers
5,147,108 A 9/1992 LaPointe
5,217,276 A 6/1993 LaPointe et al.
5,271,660 A 12/1993 LaPointe et al.
5,292,170 A 3/1994 LaPointe et al.
5,294,177 A 3/1994 Rasnick et al.
5,368,366 A 11/1994 Mizelle
5,419,611 A 5/1995 Cook
5,527,095 A * 6/1996 Marshall et al. ..... 297/270.1
5,567,009 A 10/1996 Fay et al.
5,876,094 A 3/1999 Hoffman
6,000,754 A 12/1999 Lawson
6,061,891 A 5/2000 Hoffman
6,120,094 A 9/2000 Parent
6,213,551 B1 4/2001 Desnoyers et al.
6,231,120 B1 5/2001 Wiecek
6,244,658 B1 6/2001 Parent et al.
6,309,015 B1 * 10/2001 Pine ..... 297/85

* cited by examiner

SELF-LOCKING ROCKER RECLINER CHAIR

BACKGROUND OF THE INVENTION

1) Field of the Invention

This invention relates generally to rocking reclining chairs, and more particularly to a rocking reclining chair having a lock for preventing the chair from rocking while in reclined and unreclined positions.

2) Description of Related Art

Reclining chairs are well known in the art and typically comprise a wood or metal frame defining a seat bottom, a seat back for cushioning a user's back, two armrests, and an extendable footrest. One type of recliner is a "three-way" reclining chair. A seated user in a three-way reclining chair can adjust the backrest into an upright position, a partly reclined "TV" position, or a fully reclined position. In the upright position, the seat back is upright and the footrest is retained in the base of the chair to allow the user's feet to rest on the floor. In the TV position, the footrest is extended and the seat back is reclined at a relatively shallow angle from the upright position, which still allows the user to watch television. In the fully reclined position the seating surfaces of the chair are nearly horizontal to the floor. Changing position from the upright to TV and fully reclined positions typically requires extension of the footrest using a lever positioned on an outer side of the armrest and pushing backward on the seat back while gripping the armrests.

Rocking reclining chairs, or rocker recliners, are reclining chairs that rock when the recliner is in an upright position. The frame of a rocker recliner typically includes a stationary base frame and a rocking frame. The rocking frame is attached to the seating surfaces and is supported by a pair of rocking cams. The rocking cams rest and reciprocate on the base frame to produce the rocking motion. The rocking frame and the base frame are also connected via a spring box which maintains contact between the rocking cams and the base frame during rocking and limits the rocking motion to prevent instability of the recliner. The spring box also biases the rocking cams, and hence the seating surfaces, to a neutral upright position when the rocker recliner is not being urged forward or backward during rocking. Due to potential instability of the recliner in the TV and fully reclined positions, most rocker recliners include a mechanism for automatically inhibiting rocking motion when in the reclined positions. Rocking is typically inhibited by a set of stops that extend down from the upper part of the rocking frame and onto the base frame or rocking cams as the footrest is extended.

Also known in the art are rocker recliners that include a lockout mechanism for manually inhibiting rocking motion, even when the rocker recliner is in the upright position. Although rocking the rocker recliner with the seat back in an upright position does not make the recliner unstable, seated users oftentimes find it difficult to rise from the chair while it is rocking. This is especially true for elderly users who lack the leg strength to stand unassisted and must grip the armrests to assist in the rising motion. The lockout mechanism, which can be controllable by a lever that moves a lock cam into contact with the rocking cams or base frame, allows the user to prevent rocking motion.

Despite the many improvements that have been made in rocker recliners, further improvement has been needed in the respect of simplifying a rocker recliner in terms of operation, structure, and expense. For example, the use of a manual lockout mechanism instead of an automatic locking mechanism complicates the operation of the rocker recliner by requiring the user to operate the lockout mechanism to prevent rocking while in the reclined positions. Also, the addition of a lockout mechanism also necessitates costly additional components and assembly time. Additionally, the design is complicated, increasing the likelihood of assembly errors and, possibly, wear or failure of the chair.

Thus, there exists a need for a rocker recliner that provides stable reclining as well as rocking and no-rocking modes in the upright position. While in the no-rocking mode in the upright position, the rocker recliner should be stable so that a seated user can use the rocker recliner for support while standing. Specifically, the armrests should remain stationary so that the seated user can grip and push on the armrests while standing. Additionally, the rocker recliner should be simple to use, and the structure should be simple for the sake of manufacturing ease and cost.

BRIEF SUMMARY OF THE INVENTION

The present invention provides a self-locking rocker recliner that addresses these needs in the prior art. The rocker recliner includes a dual-action locking mechanism that adjusts between an unlocked position in which the rocker recliner can rock and a locked position in which rocking is inhibited. The dual-action locking mechanism is adjusted automatically when the rocker recliner is reclined, but can also be adjusted manually by a lockout lever that is rotated by a user. Thus, the rocker recliner provides an automatic no-rocking mode for stability when the rocker recliner is reclined and a manual no-rocking mode whenever the user desires additional stability, for example while standing from or sitting into the chair.

In one embodiment of the present invention, the rocker recliner includes a base frame and a rocking frame that is rockably connected to said base frame. The rocking frame includes two rocking cams that rest and reciprocate on the base frame. Rocking is also facilitated by a spring box that biases the rocking frame to a neutral position. The rocking frame supports seating surfaces of the rocker recliner, such as a seat back, a seat bottom, a footrest, and armrests. The rocking frame preferably includes an upper rocking frame and a lower rocking frame that are movably connected so that the rocker recliner can be adjusted between an upright position and at least one reclined position, such as a TV or fully reclined position. The rocker recliner can be reclined by rotating a recline lever on the side of the rocker recliner, and reclining the rocker recliner can also cause the extension of a footrest. A lockout lever, which is attached to the rocker recliner, is configured to be moved by a user between a locked position and an unlocked position. The lockout lever is linked to a dual-action locking mechanism rotatably connected to the rocker recliner such that rotation of the lockout lever causes a corresponding rotation of the dual-action locking mechanism between a locked position and an unlocked position. Rotation of the dual-action locking mechanism to the locked position prevents rocking of the rocker recliner. The dual-action locking mechanism is also configured to rotate to the locked position when the rocking frame is reclined to the reclined position. In one embodiment, an over-center mechanism biases the dual-action locking mechanism to the locked and unlocked positions. In another embodiment, the lockout lever is located between an armrest and a seat bottom of the rocker recliner. This location provides convenient access for the user while maintaining the pleasing appearance of the rocker recliner.

In another embodiment of the present invention, the rocker recliner includes a base frame, a lower rocking frame, at least one seating surface attached to the lower rocking frame, and an upper rocking frame. The lower rocking frame is rockably connected to the base frame by at least one rocking cam. The rocking cam is supported by the base frame and defines a curved surface that defines an arcuate rocking motion of the lower rocking frame relative to the base frame. The upper rocking frame is movably connected to the lower rocking frame by a recline linkage configured to adjust the upper rocking frame between an upright position and a reclined position relative to the lower rocking frame. The rocker recliner also includes a dual-action locking member, a lockout linkage, a recline linkage, and a stop blocker. The dual-action locking member is rotatably connected to the lower rocking frame such that the dual-action locking member can pivot about a pivot pin between a locked position and an unlocked position. The dual-action cam plate can be biased to the locked and unlocked positions by an over-center mechanism. The lockout linkage is connected to the dual-action locking member and configured to rotate the dual-action locking member between the locked and unlocked positions. A lockout lever can attach to the lockout linkage so that moving the lockout lever to a locked position causes the dual-action locking member to be moved to the locked position thereof regardless of position of the recline linkage. The recline lock link extends from the recline linkage and is connected to the dual-action locking member such that adjusting the recline linkage to the reclined position causes the recline lock link to rotate the dual-action locking member to the locked position. When the dual-action locking member is in the locked position, the stop blocker is configured to contact the base frame. The stop blocker can be connected to a blocker plate that defines a slot for retaining a stud attached to the base frame. The dual-action locking member can include a dual-action cam plate that defines a cam plate slot that retains a stud attached to the recline lock link. Alternatively, a dual-action linkage can connect the dual-action locking member to the stop blocker and dual-action lock link. A slot connection connects the dual-action linkage to the recline linkage. For example, the dual-action linkage can define a slot that retains a stud attached to the recline lock link.

Thus, the present invention provides a rocker recliner which inhibits rocking while the rocker recliner is in a reclined position and, alternately, when a lockout lever is in a locked position. The lockout lever can be locked while the rocker recliner is in the upright position so that the rocker recliner provides stability to a user that is standing from or sitting into the rocker recliner. Specifically, the seating surfaces, such as the armrests, are held stationary so that the seated user can grip and push on the armrests while standing. Additionally, both reclining and the manual lockout cause rocking to be inhibited by a dual-action locking mechanism, thus simplifying and economizing the design and manufacture of the rocker recliner.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
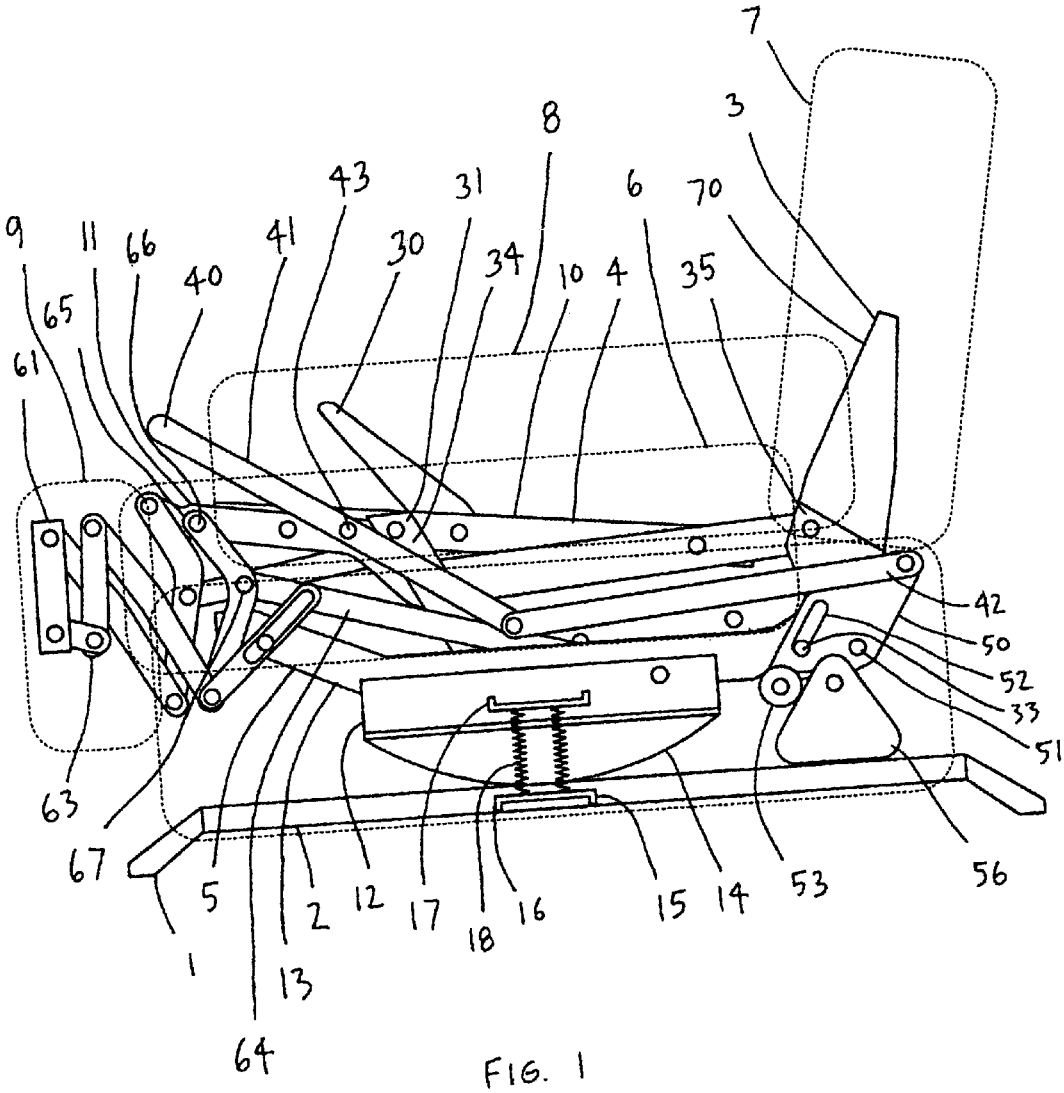
FIG. 1 is an elevation view of a rocker recliner according to one embodiment of the present invention.

Referring now to FIG. 1, there is shown a rocker recliner 1 according to the present invention. The seating surfaces of the rocker recliner 1 include a seat bottom 6, a seat back 7, armrests 8, and a footrest cushion 9. The seating surfaces 6, 7, 8, 9 are attached to a rocking frame 3 so that the seating surfaces 6, 7, 8, 9 rock in unison with the rocking frame 3. The rocking frame 3 is rockably connected to a base frame 2. The base frame 2 and rocking frame 3 may be seen more clearly in FIG. 2, which shows the rocker recliner of FIG. 1 partially assembled for clarity. The base frame 2 and the rocking frame 3 contact each other via a pair of rocking cams 14 (only one visible in the figures), each of which define a curved surface. In the embodiment shown, the rocking cams 14 are fixedly attached to the rocking frame 3 and positioned so that the curved surfaces of the rocking cams 14 rest on the base frame 2. The rocking cams 14 can be moved in a reciprocal motion by rolling the curved surfaces of the rocking cams 14 against the base frame 2 to achieve a rocking motion of the rocking frame 3. Thus, the curved surfaces of the rocking cams 14 and the mating surfaces of the base frame 2, which are flat in this embodiment, define the arcuate rocking motion of the rocking frame 3. When the rocking cams 14 reciprocate, the rocking frame 3 tilts through a range of forward and rearward positions. The rocking frame 3 is shown in a neutral, or non-tilted, position.

The rocking frame 3 is biased to the neutral position by a spring box 15 that connects the rocking frame 3 to the base frame 2. In this case, the spring box 15 is connected to the rocking frame 3 at a lower rocking frame angle 12 which is mounted on the rocking cams 14. The spring box 15 comprises a first side 16 and a second side 17. Each of the first and second sides 16, 17 are attached to opposite ends of a plurality of springs 18. The first side 16 of the spring box 15 is attached to the base frame 2, and the second side 17 of the spring box 15 is attached to the rocking frame 3. When the springs 18 are stretched, they exert a force on each of the first and second sides 16, 17 in the direction of the opposite side 17, 16. Thus, the rocking frame 3, and hence each rocking cam 14, is held against the base frame 2 by the spring box 15 during rocking. Further, the spring box 15 biases the rocking frame 3 so that the rocking frame 3 is returned to, and maintained in, the neutral position when the rocking frame 3 is not being rocked.

The rocking frame 3 includes a lower rocking frame 5 and an upper rocking frame 4. The lower rocking frame 5 is fixedly attached to the rocking cams 14, and the upper rocking frame 4 is movably connected to the lower rocking frame 5 by a recline linkage 31. In addition to the rocking cams 14 and the lower rocking frame angle 12, the lower rocking frame 5 comprises a lower rocking frame plate 13 that is fixedly attached to the lower rocking frame angle 12. The upper rocking frame 4 comprises an upper rocking frame angle 10 and an upper rocking frame plate 11, which are fixedly attached to each other.

Figure 2:
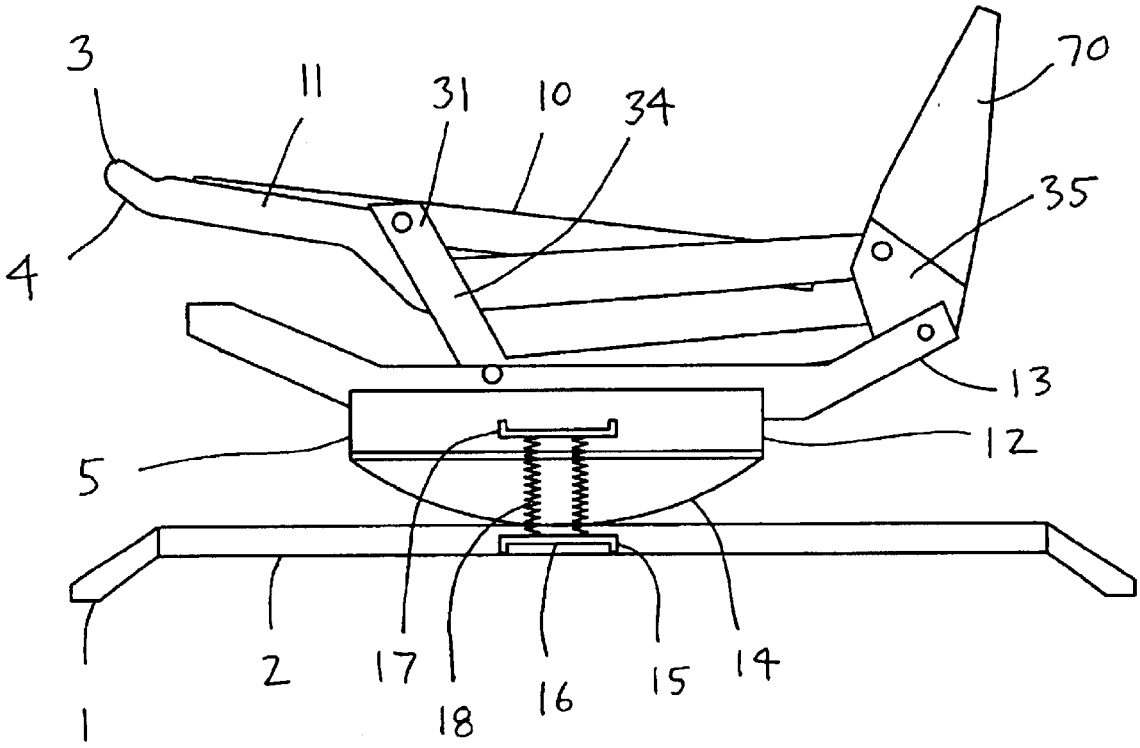
FIG. 2 is an elevation view of the rocker recliner of FIG. 1 during assembly.

The recline linkage 31, which is shown more clearly in FIG. 2, connects the upper rocking frame 4 to the lower rocking frame 5. Thus, the recline linkage 31 comprises one or more links that connect the upper rocking frame angle 10 and upper rocking frame plate 11 of the upper rocking frame 4 to the lower rocking frame angle 12 and the lower rocking frame plate 13. In the embodiment shown in FIG. 2, the recline linkage 31 includes a front recline link 34 and a rear recline link 35. The lengths and orientation of the links 34, 35 that comprise the recline linkage 31 are designed to allow the upper rocking frame 4 to move relative to the lower rocking frame 5 and thus recline the rocker recliner 1. In this embodiment, the rear recline link 35 is rigidly attached to a seat back support 70 which supports the seat back of the rocker recliner 1. The rear recline link 35 is designed and oriented so that when the upper rocker frame 4 is reclined, the rear recline link 35 reclines the seat back support 70.

Figure 3:
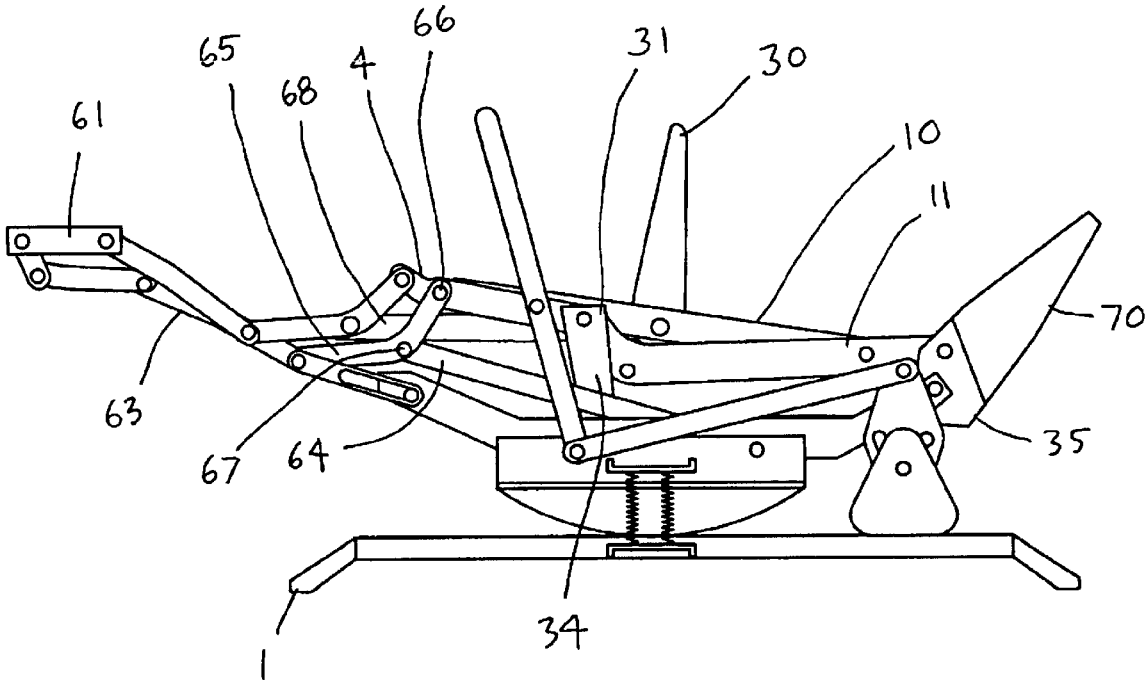
FIG. 3 is an elevation view of the rocker recliner of FIG. 1 in a reclined position.

The operation of the recline linkage 31 is illustrated in FIG. 3 which shows the rocker recliner 1 with the upper rocking frame 4 adjusted to a reclined position. The upper rocking frame angle 10 and the upper rocking frame plate 11 are rotated slightly clockwise, so that the upper rocking frame 4 is reclined toward the back of the rocker recliner 1. The front recline link 34 and the rear recline link 35 are also rotated clockwise when the recline linkage 31 is adjusted to recline the rocker recliner 1 from the upright position to the reclined position. The rotation of the rear recline link 35 reclines the seat back support 70 to a more horizontal orientation.

A user adjusts the rocker recliner 1 between the upright, TV, and reclined positions by reclining or inclining the upper rocking frame 4 relative to the lower rocking frame 3 by adjusting the recline linkage 31. In this embodiment, the recline linkage 31 is controlled by rotating a recline lever 30 that extends from one side of the rocker recliner 1. The recline lever 30 has upright, TV, and reclined positions that correspond to the upright, TV, and reclined positions of the rocker recliner 1. For example, when the recline lever 30 is rotated from the upright position to the reclined position, the forward end of the upper rocking frame 4 is moved up and the rearward end of the upper rocking frame 4 is moved down. The seat back support 70, which supports the seat back 7, is reclined toward the horizontal.

Rotation of the recline lever 30 also controls the extension of a footrest 61. As shown in FIG. 1, the footrest 61 comprises a footrest cushion 9 that is supported by a footrest linkage 63 which is attached to the upper rocking frame 4. The footrest linkage 63 also includes a footrest support link 64 that is rotatably attached to the lower rocking frame 5. The footrest support link 64 extends from the lower rocking frame 5 to a footrest extension link 65. The footrest extension link 65 is rotatably attached to the footrest support link 64 and the upper rocking frame 4. As the recline linkage 31 reclines or inclines and the upper rocking frame 4 moves relative to the lower rocking frame 5, the footrest linkage 63 is extended or reclined respectively. For example, as the upper rocking frame 4 is reclined, a pinned connection 66 between the footrest extension link 65 and the upper rocking frame 4 moves toward the back of the rocker recliner 1, rotating the footrest extension link 65 about a pinned connection 67 between the footrest support link 64 and the footrest extension link 65. The rotation and extension of the footrest extension link 65 cause a scissoring action in the footrest linkage 63, extending the footrest cushion 9 and rotating it upwards.

Figure 4:
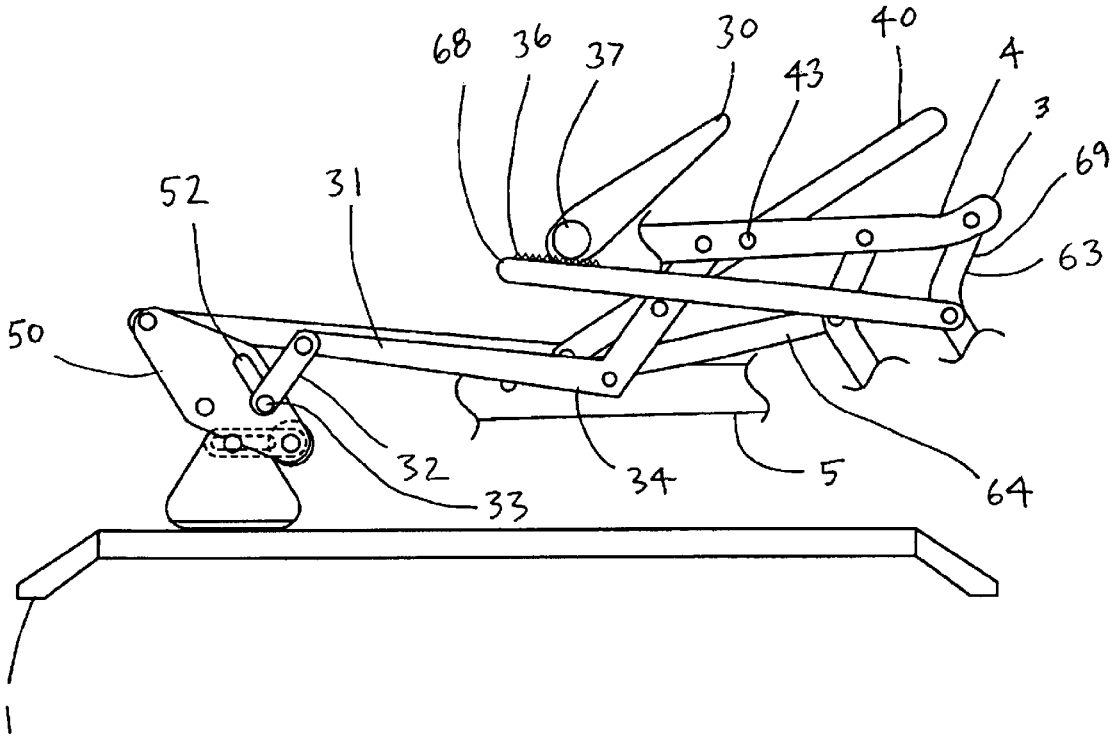
FIG. 4 is a partial elevation view of the rocker recliner of FIG. 1 illustrating the recline linkage and the dual-action locking mechanism in an unlocked position.
Figure 5:
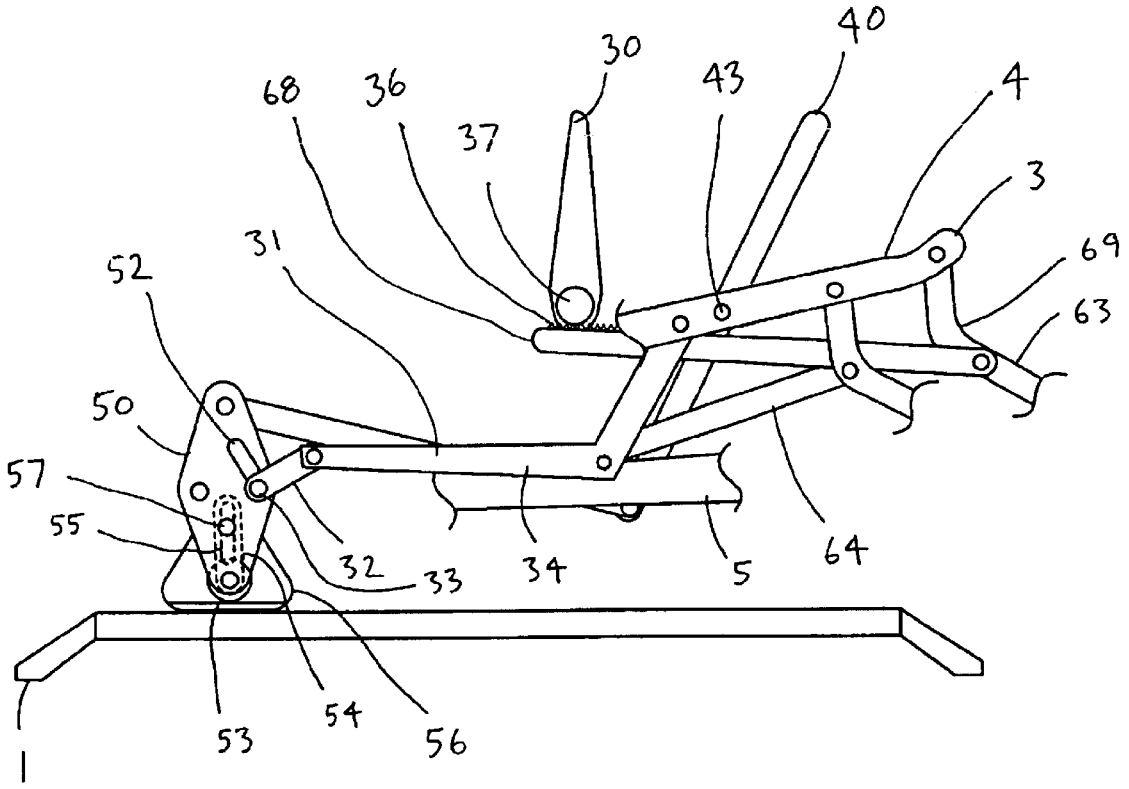
FIG. 5 is a partial elevation view of the rocker recliner of FIG. 1 illustrating the recline linkage and the dual-action locking mechanism in a locked position.

The interaction of the recline linkage 31 and the footrest linkage 63 is shown more clearly in FIGS. 4 and 5. As shown, the front recline link 34 is rotatably connected to both the upper rocking frame 4 and the lower rocking frame 5. The footrest linkage 63 is connected to the upper rocking frame 4 and to the lower rocking frame 5 via the footrest support link 64. Thus, as the upper rocking frame 4 reclines relative to the lower rocking frame 5, corresponding motion occurs in both the recline linkage 31 and the footrest linkage 63. Further, the recline lever 30, which controls the reclining motion of the upper rocking frame 4, can act on either or both of the recline linkage 31 and the footrest linkage 63. In the embodiment of FIG. 5, the recline lever 30 is connected to the footrest linkage 63 via a footrest control link 68. The footrest control link 68 extends from the recline lever 30 to a second footrest extension link 69. The footrest control link 68 includes a rack gear 36 that engages a pinion gear 37 attached to the recline lever 30. Rotation of the recline lever 30 causes translation of the footrest control link 68 and a corresponding action in the second footrest extension link 69, extending or retracting the footrest linkage 63. The extension or retraction of the footrest linkage 63 effects the reclining motion of the upper rocking frame 4, reclining or inclining the rocker recliner 1, respectively.

Figure 6:
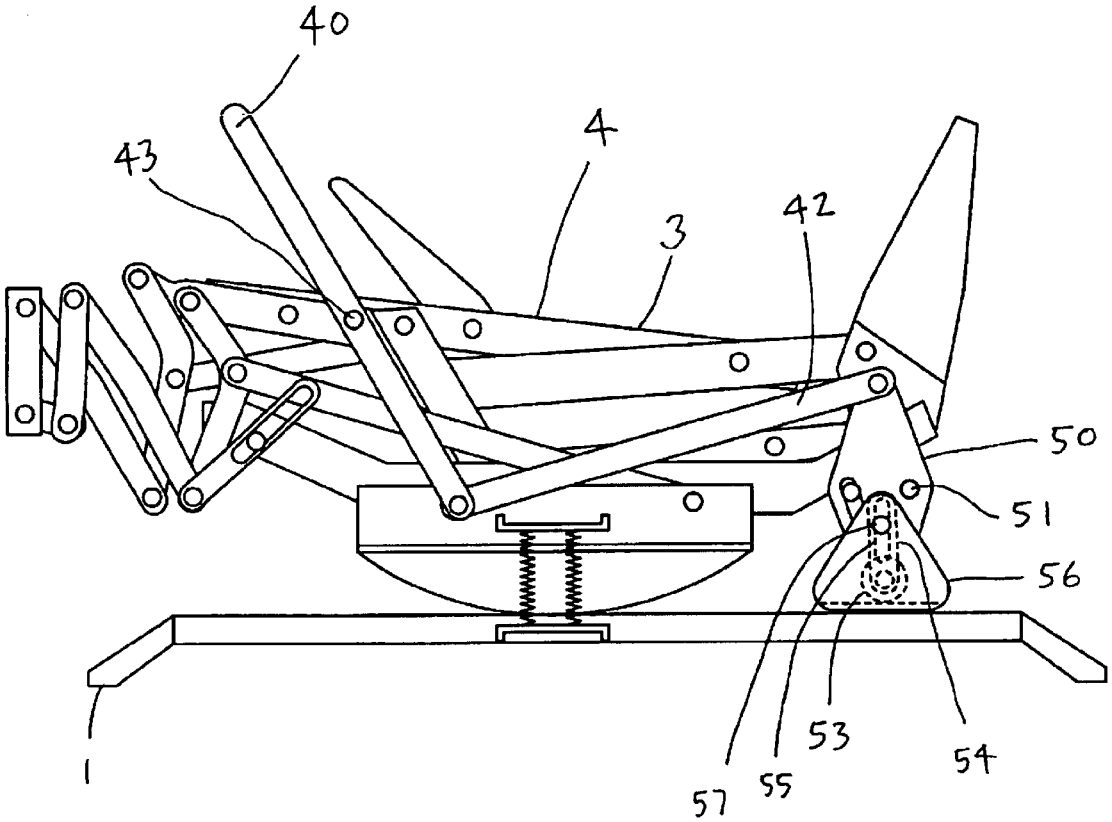
FIG. 6 is an elevation view of the rocker recliner of FIG. 1 in an upright position and with the dual-action locking mechanism in a locked position.

As shown in FIG. 6, the rocking motion of the rocking frame 3 can be inhibited by a dual-action locking mechanism such as a dual-action cam plate 50 that is pivotally mounted to the rocking frame 3 by a cam plate pivot pin 51 affixed to the lower rocking frame 5. The dual-action cam plate 50 rotates about the pivot pin 51 between a locked position and an unlocked position. When the dual-action cam plate 50 is in the unlocked position, as in FIG. 1, the rocking frame 3 can rock. However, when the dual-action cam plate 50 is rotated to the locked position, as in FIG. 6, a blocker roller 53, rotatably connected to the dual-action cam plate 50 is moved into contact with a stop angle 56 of the base frame 2. The blocker roller 53, which may be any type of stop blocker such as a roller, pad, or plate, is also rotatably connected to a blocker roller plate 54. The blocker roller plate 54 defines a blocker roller plate slot 55 that retains a stud 57 attached to the stop angle 56. When the dual-action cam plate 50 is in the locked position, the blocker roller 53 inhibits the rocking frame 3 from rocking backward relative to the base frame 2. For example, in FIG. 1 the dual-action cam plate 50 is in the unlocked position and therefore the blocker roller 53 is separated from the stop angle 56 of the base frame 2 so that the blocker roller 53 does not impede the rocking motion of the rocking frame 3. In FIGS. 5 and 6, however, the dual-action cam plate 50 has been rotated to the locked position, counter-clockwise in FIG. 6 for example. The blocker roller 53, which in these Figures has been rotated behind the stop angle 56, rests against the stop angle 56 of the base frame 2 and prevents vertical movement of the dual-action cam plate 50 and, hence, rocking of the rocking frame 3.

The rocking motion of the rocking frame 3 can be inhibited manually by rotating a lockout lever 40 which controls the dual-action cam plate 50. As shown in FIG. 6, the lockout lever 40 is rotatably attached to the upper rocking frame 4 by a lockout lever pivot pin 43. As the lockout lever 40 is rotated about the lockout lever pivot pin 43, the lockout lever 40 moves a lockout link 42, which is rotatably connected to the lockout lever 40. The lockout link 42 extends to, and is rotationally connected to, the dual-action cam plate 50. Thus, as the lockout lever 40 is rotated, the dual-action cam plate 50 rotates about the cam plate pivot pin 51. When the lockout lever 40 is rotated to a locked position, clockwise in the Figure, the dual-action cam plate 50 is rotated to its locked position. Similarly, when the lockout lever 40 is rotated to an unlocked position, counter-clockwise in the Figure, the dual-action cam plate 50 is rotated to its unlocked position. Thus, a user seated in, or standing near, the rocker recliner 1 can alternately enable and disable the rocking ability of the rocker recliner 1 using the lockout lever 40. For example, a user standing near the rocker recliner 1 can pull the lockout lever 40 up to the locked position to increase the stability of the rocker recliner 1 before the user sits down. Once seated in the rocker recliner 1, the user can rotate the lockout lever 40 to the unlocked position, enabling rocking. When the user is ready to stand up, the user can rotate the lockout lever 40 again to the locked position. Although the lockout lever 40 can be used anytime, it is especially useful before sitting in or standing from the rocker recliner 1 because of the increased need for stability during those times.

In a preferred embodiment, the lockout lever 40 extends through the seating surface between the seat bottom 6 and one of the armrests 8. This location allows a user in or near the rocker recliner 1 to easily access the lockout lever 40 without detracting from the aesthetic appeal of the rocker recliner 1.

As shown in FIGS. 4 and 5, the dual-action cam plate 50 can also be rotated automatically by a recline lock link 32 that is attached to the recline linkage 31. The dual-action cam plate 50 defines a cam plate slot 52 in which slides a stud 33 that is connected to the recline lock link 32. Thus, the recline lock link 32 extends from the recline linkage 31 to the dual-action cam plate 50. When the lockout lever 40 is in the unlocked position and the recline linkage 31 is adjusted to recline the upper rocking frame 4, the stud 33 on the recline lock link 32 moves to the bottom end of the cam plate slot 52 and then rotates the dual-action cam plate 50 about the cam plate pivot pin 51. However, when the recline linkage 31 is adjusted from one of the reclined positions to the upright position, the stud 33 on the recline lock link 32 moves within the slot 52 and the stud 33 does not rotate the dual-action cam plate 50. Thus, when the rocker recliner 1 is adjusted from one of the reclined positions to the upright position, the rocker recliner 1 remains in the locked position until the lockout lever 40 is moved from the locked position to the unlocked position.

For example, in the partial view of FIG. 4, the rocker recliner 1 is shown in the unreclined position, and the dual-action cam plate 50 is in its unlocked position. Therefore, the blocker roller 53 is separated from the base frame and does not impede rocking of the rocker recliner 1. In FIG. 5, the recline lever 30 is shown rotated to the reclined position. The pinion gear 37 connected to the recline lever 30 and engaged with the rack gear 36 translates the footrest control link 68 towards the front of the rocker recliner 1. The footrest control link 68 extends the footrest linkage 63 which reclines the upper rocking frame 4. As the upper rocking frame 4 reclines, the front recline link 34 rotates, moving the recline lock link 32 downward and towards the rear of the rocker recliner 1. Stud 33 attached to the recline lock link 32 moves to the bottom of the cam plate slot 52 in the dual-action cam plate 50 and rotates the dual-action cam plate 50 into the locked position, with blocker roller 53 resting against the stop angle 56 of the base frame 2.

In the foregoing examples, the dual-action locking mechanism comprises the dual-action cam plate 50, which is rotatably attached to the blocker roller 53. The dual-action cam plate 50 described above also defines the cam plate slot 52 that provides a slotted connection between the dual-action locking mechanism and the recline lock link 32. However, the dual-action locking mechanism of the present invention can also comprise additional or alternative elements. For example, according to an alternative embodiment of the dual-action locking mechanism of the present invention illustrated in FIGS. 7–9, a dual-action locking member 90 is rotatably connected by a pin 91 to a plate 87 that is attached to the base frame 2. The dual-action locking member 90 is connected to the blocker roller 53 and the recline lock link 32 by way of a dual-action linkage 80. The dual-action linkage 80 is rotatably connected to the dual-action locking member 90 and a blocker linkage 84, which is attached to the blocker roller 53 and defines an arcuate field of motion through which the blocker roller 53 can be moved. The dual-action linkage 80 also defines a slot 82 that retains the stud 33 on the recline lock link 32. Thus, as similarly described above in connection with the dual-action cam plate 50 of FIGS. 1–6, the dual-action locking member 90 can be pivoted by the lockout lever 40 to the locked position as shown in FIG. 8. Additionally, the dual-action locking member 90 can be rotated automatically by the recline lock link 32, which is connected to the recline linkage 31. Thus, if the dual-action locking member 90 is in an unlocked position, adjusting the recline linkage 31 to a reclined position rotates the dual-action locking member 90 to a locked position, as shown in FIG. 9. Rotation of the dual-action locking member 90 to the locked position adjusts the dual-action linkage 80 and the blocker linkage 84 to put the blocker roller 53 in engagement with a stop angle 88 connected to the base frame 2 to prevent the rocker recliner 1 from rocking. In the locked position, the blocker linkage 84 prevents the dual-action linkage 80 from moving up or down, thereby preventing rocking of the rocker recliner 1 in both the forward and rearward directions.

Figure 7:
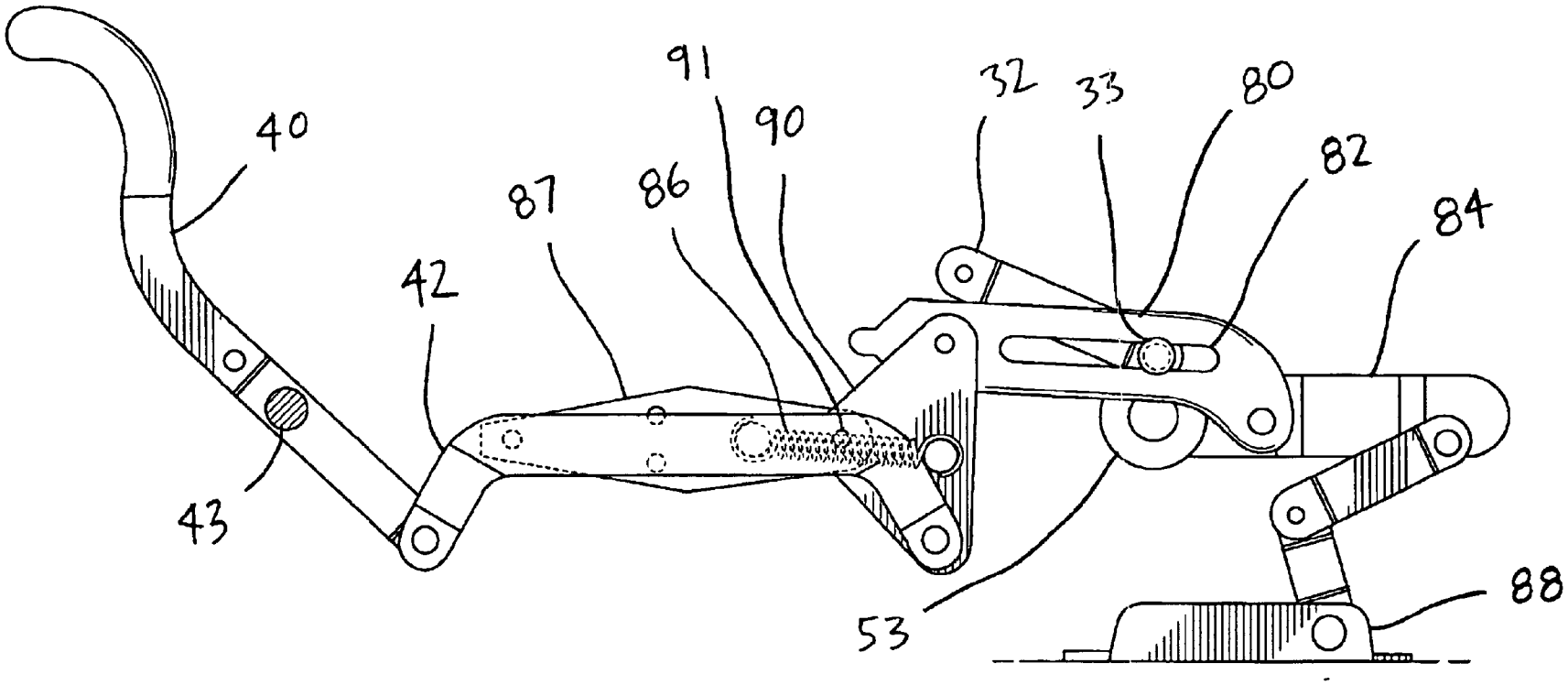
FIG. 7 is an elevation view of a dual-action locking mechanism in an unlocked position according to another embodiment of the present invention.
Figure 8:
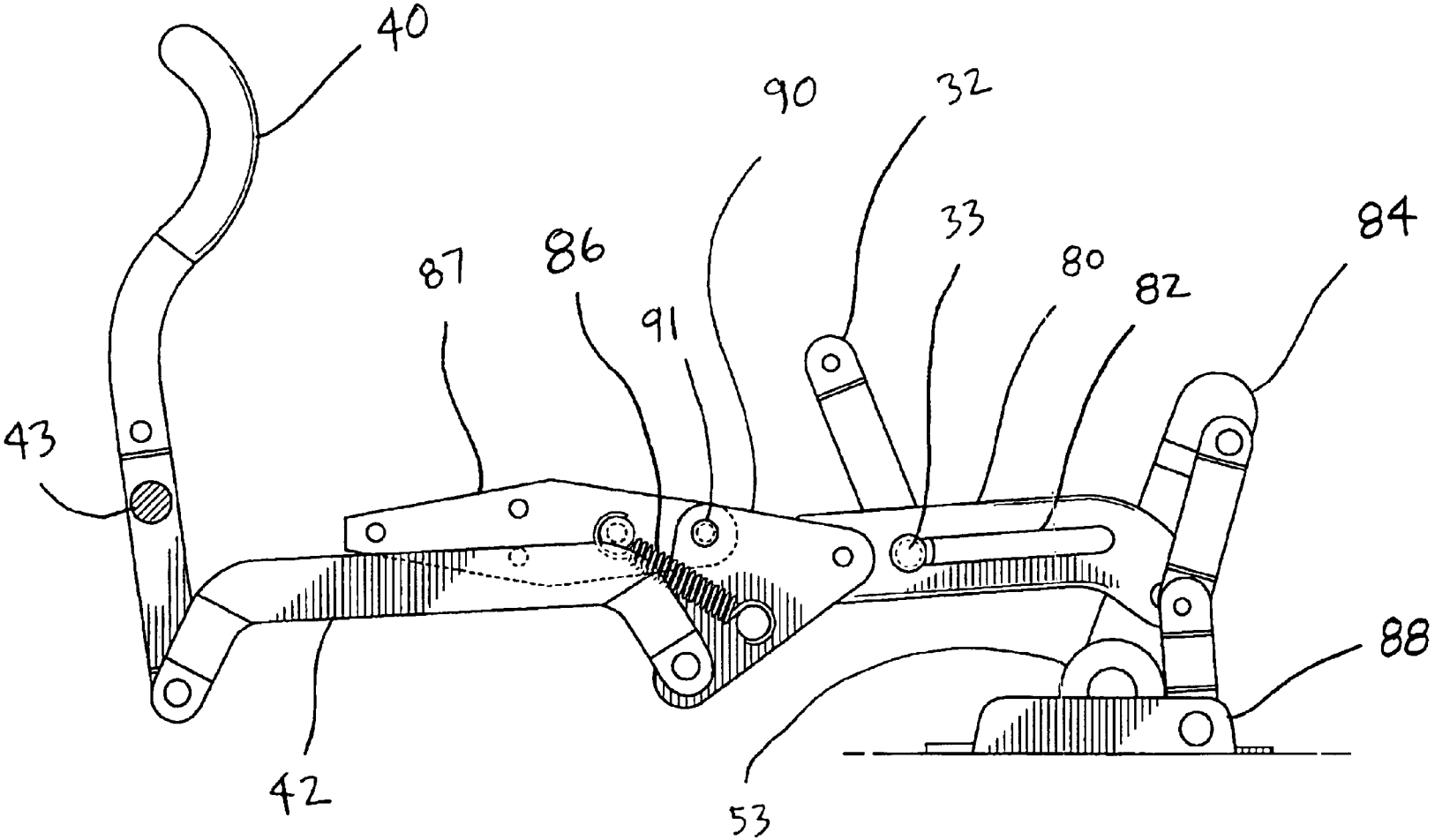
FIG. 8 is an elevation view of the dual-action locking mechanism of FIG. 7 in a locked position.
Figure 9:
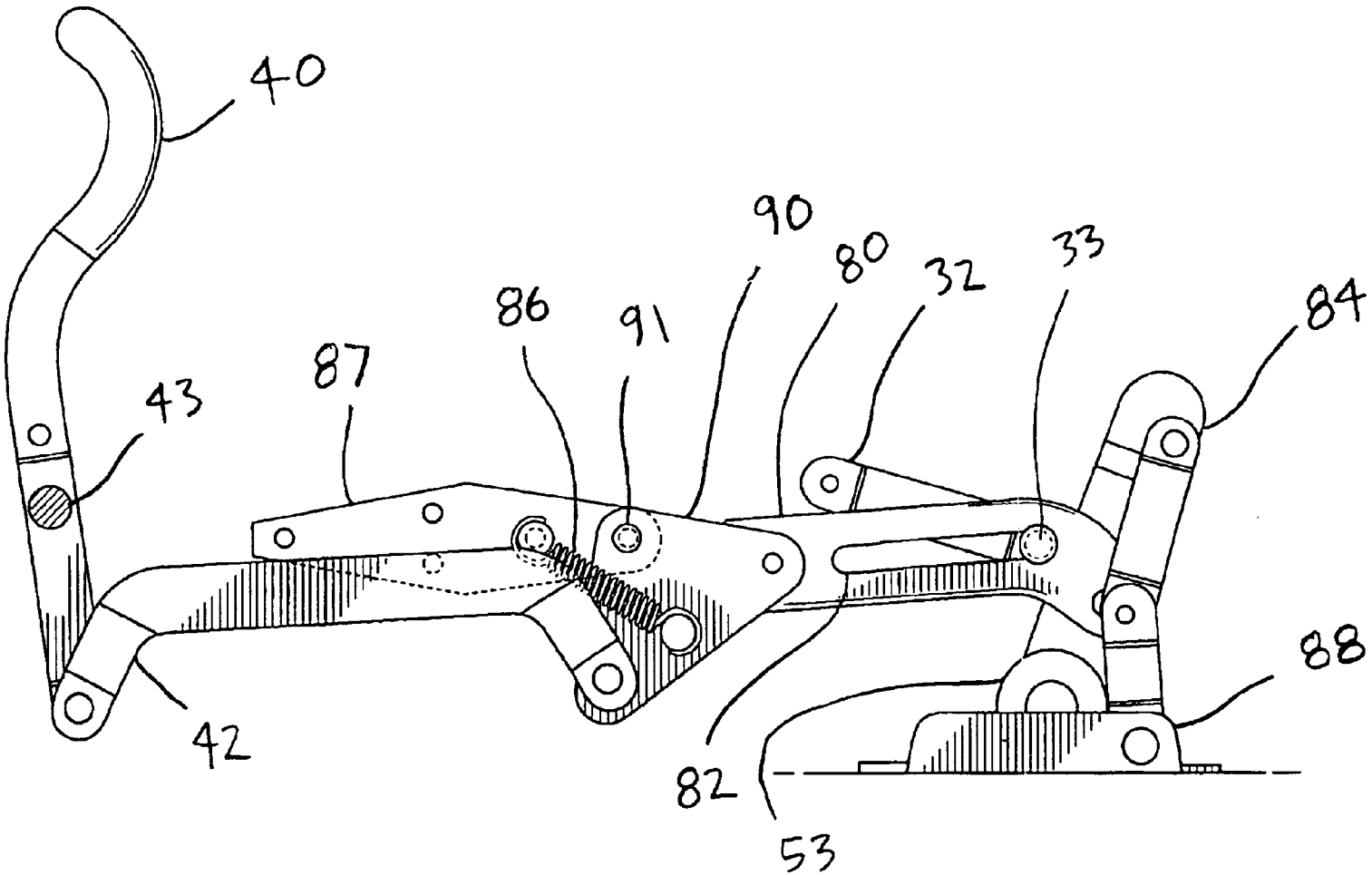
FIG. 9 is an elevation view of the dual-action locking mechanism of FIG. 7 in a locked position with the recline lock link in the reclined position.

There is also shown in FIGS. 7–9 a biasing spring 86 that provides a force between the dual-action locking member 90 and the plate 87 that is attached to the base frame 2. The biasing spring 86 provides an over-center mechanism that biases the position of the dual-action locking member 90 and, hence, the blocker roller 53, to the locked and unlocked positions. The biasing spring 86 increases the force necessary to rotate the dual-action locking member 90 from both the unlocked and locked positions. Thus, the biasing spring 86 prevents inadvertent or unintentional rotation of the dual-action locking member 90 from the locked position to the unlocked position or from the unlocked position to the locked position, for example, during rocking. Although the biasing spring 86 is connected to the dual-action locking member 90 in FIGS. 7–9, in other embodiments of the invention the biasing spring 86 acts on other elements such as the recline lock link 32, the recline linkage 31, the lockout lever 40, or the lockout link 42. Further, the over-center mechanism can comprise any number of coil biasing springs 86 or a variety of other biasing components such as other types of springs, mechanical or electromechanical lockouts, and the like. The over-center mechanism is not limited to use with the dual-action locking mechanism shown in FIGS. 7–9, and can be used, for example, with the dual-action cam plate 50 of FIGS. 1–5.

It is also understood that a rocker recliner 1 according to the present invention may include two or more of each of the elements shown in the Figures. Thus, a rocker recliner 1 may comprise two similar frames, such as the one shown in FIG. 1, one on each side of the rocker recliner 1. The two frames may be connected by connection links (not shown) so that an adjustment in the configuration of one side frame is also similarly achieved in the frame of the other side. The connection links may also make some components unnecessary on one side. For example, the lockout lever 40, recline lever 30, and dual-action cam plate 50 may be used on only one side of the rocker recliner 1.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A rocker recliner comprising:

a base frame;

a rocking frame rockably connected to said base frame, wherein said rocking frame is configured to be adjusted between an upright position and at least one reclined position;

at least one seating surface attached to said rocking frame;

a lockout lever attached to the rocker recliner and configured to be moved by a user between a locked position and an unlocked position; and a dual-action locking mechanism that locks to prevent rocking of said rocking frame in response to adjustment of said rocking frame to the at least one reclined position and also in response to movement of said lockout lever to the locked position, said dual-action locking mechanism being configured to lock in response to a select one of said lockout lever and said rocking frame, and said dual-action locking mechanism being unlocked to allow rocking of said rocking frame in response to movement of said lockout lever to the unlocked position.

2. The rocker recliner of claim 1 wherein said dual-action locking mechanism comprises a dual-action locking member connected to said lockout lever, rotatably connected to the rocker recliner, and configured to rotate between a locked position and an unlocked position, wherein rotation of said dual-action locking member to the locked position prevents rocking of said rocking frame relative to said base frame, said dual-action locking member is configured to rotate to the locked position in response to adjustment of said rocking frame to the at least one reclined position, said dual-action locking member is configured to rotate to the locked position in response to adjustment of said lockout lever to the locked position, and said dual-action locking member is configured to rotate to the unlocked position in response to adjustment of said lockout lever to the unlocked position.

3. The rocker recliner of claim 1 further comprising an over-center mechanism connected to said dual-action locking mechanism and providing a force tending to prevent said dual-action locking mechanism from inadvertently moving out of a selected one of a locked position and an unlocked position.

4. The rocker recliner of claim 1 wherein said rocking frame comprises a lower rocking frame and an upper rocking frame, said upper rocking frame movably connected to said lower rocking frame.

5. The rocker recliner of claim 4 wherein said seating surface is attached to said upper rocking frame.

6. The rocker recliner of claim 5 wherein said seating surface comprises a seat back, a seat bottom, and two armrests.

7. The rocker recliner of claim 1 wherein said seating surface comprises an armrest and a seat bottom and wherein said lockout lever extends to a location between said armrest and said seat bottom.

8. The rocker recliner of claim 1 wherein the at least one reclined position of said rocking frame is characterized by a position of said seatback that is more horizontal relative to a position of said seatback in the upright position of said rocking frame.

9. The rocker recliner of claim 1 further comprising an extendable footrest and wherein the at least one reclined position of said rocking frame is characterized by the extension of said footrest.

10. The rocker recliner of claim 1 further comprising a recline lever, said recline lever rotatably connected to the rocker recliner and configured so that rotation of said recline lever configures the rocker recliner from the upright position to the at least one reclined position.

11. The rocker recliner of claim 10 wherein said recline lever is configured so that rotation of said recline lever extends a footrest.

12. The rocker recliner of claim 1 further comprising a spring box having a first side and a second side, wherein said first side is attached to said base frame and said second side is attached to said rocking frame and wherein said spring box biases said rocking frame to a neutral position.

13. The rocker recliner of claim 1 further comprising two rocking cams attached to said rocking frame, each of said rocking cams having a curved lower surface that rests on said base frame such that said rocking cams can reciprocate relative to said base frame to achieve a rocking motion of said rocking frame.

14. The rocker recliner of claim 1 wherein said lockout lever is linked to said dual-action locking mechanism such that rotation of said lockout lever to the locked position rotates and locks said dual-action locking mechanism and prevents rocking of said rocking frame while said rocking frame is in the upright position.

15. A rocker recliner comprising:

a base frame;

a lower rocking frame rockably connected to said base frame wherein said lower rocking frame is supported by at least one rocking cam, said at least one rocking cam is supported by said base frame, and said at least one rocking cam defines a curved surface that defines an arcuate rocking motion of said lower rocking frame relative to said base frame;

an upper rocking frame movably connected to said lower rocking frame by a recline linkage, said recline linkage configured to adjust said upper rocking frame between an upright position and a reclined position relative to said lower rocking frame;

at least one seating surface attached to said upper rocking frame;

a dual-action locking member rotatably connected to said lower rocking frame such that said dual-action locking member can pivot about a pivot pin between a locked position and an unlocked position;

a stop blocker connected to said dual-action locking member and configured to contact said base frame while said dual-action locking member is in the locked position;

a lockout linkage connected to said dual-action locking member and configured to rotate said dual-action locking member between said locked and unlocked positions; and a recline lock link extending from said recline linkage, said recline lock link connected to said dual-action locking member such that adjusting said recline linkage to the reclined position causes said recline lock link to rotate said dual-action locking member to said locked position, wherein said dual-action locking mechanism is configured to lock in response to the adjustment of said lockout linkage without an adjustment of said rocking frame to the reclined position.

16. The rocker recliner of claim 15 further comprising an over-center mechanism connected to said dual-action locking member and configured to bias said dual-action locking member to the locked position and the unlocked position.

17. The rocker recliner of claim 15 wherein said dual-action locking member comprises a dual-action cam plate defining a cam plate slot, and said cam plate slot retains a stud attached to said recline lock link.

18. The rocker recliner of claim 15 wherein said stop blocker is connected to a blocker plate and said blocker plate defines a slot that retains a stud attached to said base frame.

19. The rocker recliner of claim 15 further comprising a dual-action linkage connecting said dual-action locking member to said stop blocker and said dual-action lock link, wherein said dual-action linkage comprises a slot connection that connects said dual-action linkage to said recline linkage.

20. The rocker recliner of claim 19 wherein said dual-action linkage defines a slot that retains a stud attached to said recline lock link.

21. The rocker recliner of claim 15 further comprising a lockout lever attached to said lockout linkage such that moving said lockout lever to a locked position causes said dual-action locking member to be moved to the locked position thereof regardless of position of said recline linkage.

* * * * *